United States Patent [19]

Ford, Jr.

[11] Patent Number: 4,957,218

[45] Date of Patent: Sep. 18, 1990

[54] FOAMER AND METHOD

[75] Inventor: George W. Ford, Jr., Salt Lake City, Utah

[73] Assignee: Ballard Medical Products, Midvale, Utah

[21] Appl. No.: 890,041

[22] Filed: Jul. 28, 1986

[51] Int. Cl.[5] ..... B67D 5/58; B65D 83/00

[52] U.S. Cl. ..... 222/1; 222/189; 222/190; 222/373; 222/401; 222/450; 222/464

[58] Field of Search ..... 222/95, 105, 190, 189, 222/209, 211, 207, 325, 335, 401, 450, 373–464; 239/331, 333

[56] References Cited

U.S. PATENT DOCUMENTS

| | | | |
|---|---|---|---|
| 296,435 | 4/1884 | Murdock . | |
| 1,792,513 | 2/1931 | Soreny | 222/173 |
| 2,103,687 | 12/1937 | McKenney | 221/94 |
| 2,153,156 | 4/1939 | Pollnow | 222/94 |
| 2,154,393 | 4/1939 | Bates | 221/77 |
| 2,213,846 | 9/1940 | Meyer | 299/88 |
| 2,275,051 | 3/1942 | Maloney | 221/85 |
| 2,275,972 | 3/1942 | Maloney | 221/85 |
| 2,319,244 | 5/1943 | Lo Cascio et al. | 290/83 |
| 2,365,195 | 12/1944 | Holihan | 299/88 |
| 2,456,958 | 12/1948 | Kretschmer et al. | 222/179 |
| 2,465,274 | 3/1949 | Rudd | 299/88 |
| 2,652,952 | 9/1953 | Mowbray | 222/180 |
| 2,665,825 | 1/1954 | Poitras et al. | 222/373 X |
| 2,680,010 | 6/1954 | Dubay | 261/124 |
| 2,751,124 | 6/1956 | Jones | 222/179 |
| 2,812,716 | 11/1957 | Gray | 103/37 |
| 2,818,998 | 1/1958 | Jones | 222/179 |
| 2,920,795 | 1/1960 | Piker | 222/131 |
| 2,988,754 | 6/1961 | Misson | 4/182 |
| 3,124,275 | 3/1964 | Lake | 222/450 X |
| 3,197,081 | 7/1965 | Midworth | 222/179 |
| 3,203,597 | 8/1965 | Birch | 222/179 |
| 3,229,854 | 2/1966 | Turnquist | 222/450 X |
| 3,233,787 | 2/1966 | Ross | 222/179 |
| 3,308,993 | 3/1967 | Bruno | 222/146 |
| 3,323,689 | 6/1967 | Elmore | 222/385 |
| 3,346,146 | 10/1967 | Thompson | 222/189 |
| 3,422,993 | 1/1969 | Bohem et al. | 222/190 |
| 3,428,222 | 2/1969 | Wright | 222/187 |
| 3,551,076 | 12/1970 | Wilson | 417/385 |
| 3,622,049 | 11/1971 | Thompson | 222/190 |
| 3,640,470 | 2/1972 | Susuki et al. | 239/333 |

(List continued on next page.)

FOREIGN PATENT DOCUMENTS

| | | | |
|---|---|---|---|
| 229360 | 3/1923 | Canada . | |
| 414650 | 8/1943 | Canada . | |
| 583961 | 9/1959 | Canada . | |
| 669247 | 8/1963 | Canada | 222/36 |
| 720699 | 11/1965 | Canada | 222/88 |
| 925836 | 5/1973 | Canada | 222/63.1 |
| 999833 | 11/1976 | Canada | 222/76 |
| 1029696 | 4/1978 | Canada | 222/76 |
| 1034096 | 7/1978 | Canada | 222/76 |
| 1059082 | 7/1979 | Canada | 222/76 |
| 1063983 | 10/1979 | Canada | 222/76 |
| 1090748 | 12/1980 | Canada | 222/69.1 |
| 1152380 | 8/1983 | Canada | 103/57 |
| 319068 | 1/1957 | Switzerland . | |
| 209724 | 11/1925 | United Kingdom . | |
| 539418 | 9/1941 | United Kingdom . | |
| 655442 | 7/1951 | United Kingdom . | |
| 1180376 | 2/1970 | United Kingdom . | |
| 1213111 | 11/1970 | United Kingdom | 312/239 |

(List continued on next page.)

*Primary Examiner*—Kevin P. Shaver
*Assistant Examiner*—Gregory L. Huson
*Attorney, Agent, or Firm*—Lynn G. Foster

[57] ABSTRACT

A foamer, and related method, wherein the foamer comprises a container in which a large supply of foamable liquid is disposed. A predetermined amount of foamable liquid is displaced from time to time from the large container to a relatively small capacity pump chamber, under force of manually-created negative pressure. Manually-created positive air pressure displaces a fixed quantity of foamable liquid from the pump chamber as a stream to a foam-creating mixing chamber where a controlled amount of the air under positive pressure is introduced into the stream of foamable liquid to produce effluent foam.

4 Claims, 4 Drawing Sheets

U.S. PATENT DOCUMENTS

| | | | |
|---|---|---|---|
| 3,709,437 | 1/1973 | Wright | 222/190 X |
| 3,820,689 | 6/1974 | Cocita | 222/207 |
| 3,824,002 | 7/1974 | Beard | 350/160 |
| 3,937,364 | 2/1976 | Wright | 222/190 |
| 3,952,924 | 4/1976 | Benson | 222/181 |
| 3,973,701 | 11/1976 | Gardner | 222/190 |
| 3,985,271 | 10/1976 | Gardner | 222/190 |
| 4,018,364 | 4/1977 | Wright | 222/190 |
| 4,022,351 | 5/1977 | Wright | 222/145 |
| 4,024,992 | 5/1977 | Schmid | 222/211 |
| 4,027,789 | 6/1977 | Dickey | 222/190 |
| 4,044,923 | 8/1977 | Gardner | 222/190 |
| 4,046,289 | 9/1977 | Teramishi | 222/146 |
| 4,098,434 | 7/1978 | Uhlig | 222/94 |
| 4,147,306 | 4/1979 | Bennett | 239/327 |
| 4,156,505 | 5/1979 | Bennett | 239/327 |
| 4,184,615 | 1/1980 | Wright | 222/190 |
| 4,219,159 | 8/1980 | Wesner | 239/343 |
| 4,274,594 | 6/1981 | Ito | 239/327 |
| 4,327,782 | 5/1982 | McKibben et al. | 141/26 |
| 4,349,129 | 9/1982 | Amneus | 222/41 |
| 4,349,131 | 9/1982 | Arabian | 222/135 |
| 4,350,298 | 9/1982 | Tada | 239/333 |
| 4,531,659 | 7/1985 | Wright | 222/190 |
| 4,531,660 | 7/1985 | Ford, Jr. | 222/207 X |

OTHER PUBLICATIONS

Highland Labs Dispenser, 8/17/78.

Cross-Sectional Drawing of Commercial Sump Foamer Marketed by Ballard Medical Products. (Market B. Exh. 142).

FOAMER AND METHOD

FIELD OF THE INVENTION

The present invention relates generally to non-aerosol foaming devices and more particularly to such a foamer, and related method, wherein the foamer comprises a container in which a large supply of foamable liquid is disposed. A predetermined amount of foamable liquid is displaced from time to time from the large container to a relatively small capacity pump chamber, under force of manually-created negative pressure. Manually-created positive air pressure displaces a fixed quantity of foamable liquid from the pump chamber as a stream to a foamcreating mixing chamber where a controlled amount of the air under positive pressure is introduced into the stream of foamable liquid to produce effluent foam.

PRIOR ART

Applicant is aware of his U.S. Pat. No. 4,531,660, the Assignee of which is the same as the present Assignee, i.e. Ballard Medical Products.

A commercial sump foamer embodiment, based on U.S. Pat. No. 4,531,660 has been on sale for more than one year. The commercial sump foamer, however, does not use vacuum to fill the pump chamber and the amount of foamable liquid used to fill the sump pump chamber and which is later dispensed therefrom is not a predetermined amount, but rather is a function of the amount of foamable liquid disposed in the large container at any point in time.

BRIEF SUMMARY AND OBJECTS OF THE INVENTION

In brief summary, the present invention comprises non-aerosol foaming device or foamer, and related method, wherein the foamer comprises a large capacity container in which a large supply of foamable liquid is placed and from which a predetermined amount of foamable liquid is displaced from time-to-time to load a relatively small capacity pump chamber forming part of the device under force of manually-created negative pressure. Manually-created positive air pressure is used, at points in time as desired by the operator, to displace a fixed quantity of foamable liquid from the pump chamber as a stream to a foam-creating fixing chamber where a controlled amount of the air under positive pressure is mixed with the stream of foamable liquid to produce effluent foam.

From the foregoing, it is a primary object of the present invention to provide a novel non-aerosol foaming device or foamer, and related method.

Another significant object of the present invention is the provision of a foamer which comprises a large capacity reservoir or container in which a large supply of foamable liquid is placed.

A further important object of the present invention is the provision of a foamer wherein a predetermined amount of foamable liquid is displaced from time-to-time from a large reservoir to a relatively small capacity pump chamber, under force of manually-created negative pressure.

A further dominant object of the present invention is the provision of a novel foamer wherein manually-created positive air pressure displaces a fixed quantity of foamable liquid from temporary storage in a pump chamber through a foam creating mixing chamber where a controlled amount of the air under positive air pressure is mixed therewith to produce effluent foam as desired by the user.

These and other objects and features of the present invention will be apparent from the detailed description taken with reference to the accompanying drawings.

DETAILED DESCRIPTION OF THE ILLUSTRATED EMBODIMENT

Figure 1:
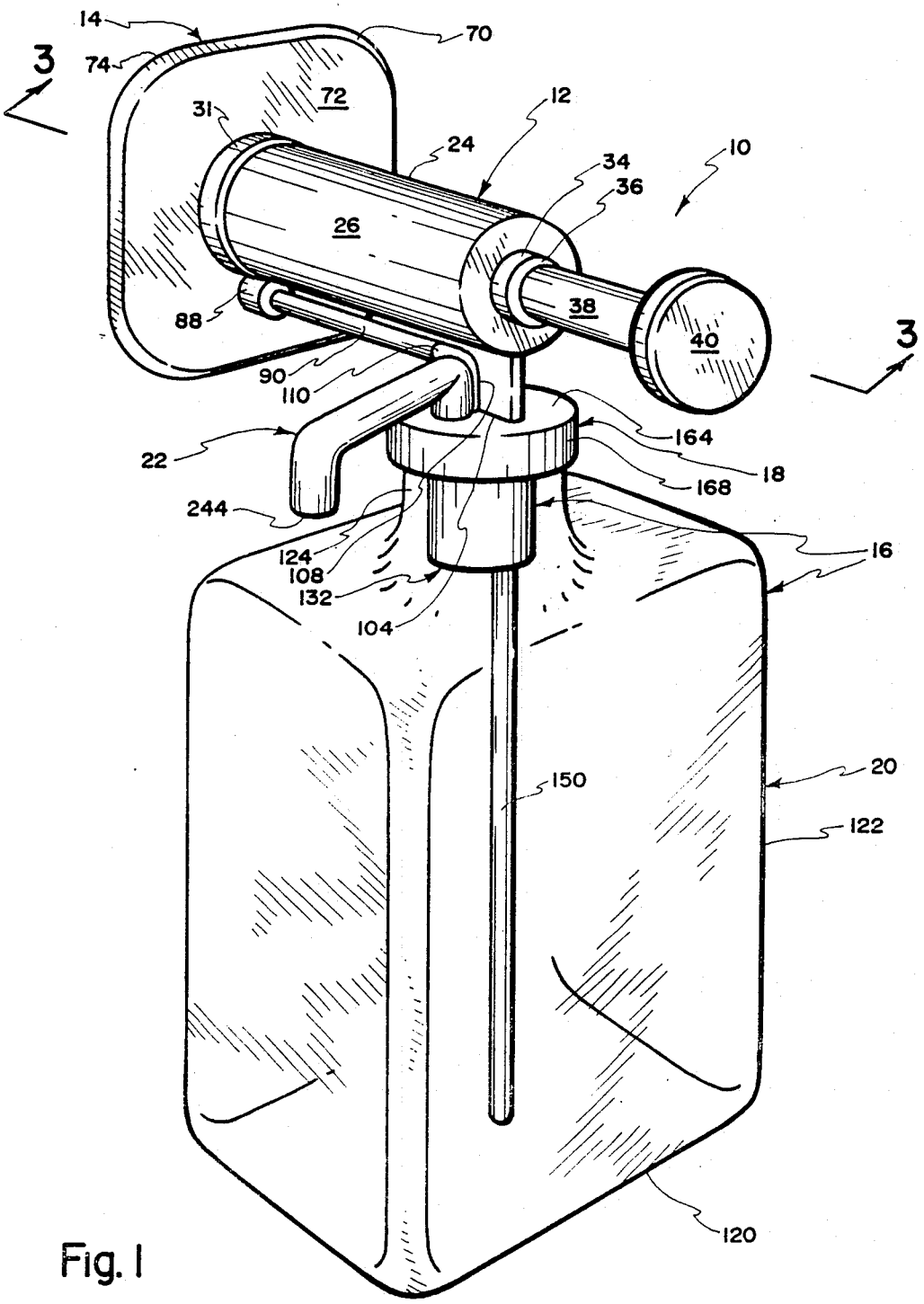
FIG. 1 is a perspective representation of a presently preferred foamer or foaming device fashioned in accordance with the principles of the present invention.

Reference is now made to the drawings wherein like numerals are used to designate like parts throughout. With particular reference to FIG. 1, the presently preferred embodiment of the present invention comprises a non-aerosol foaming device, also known as a foamer, generally designated 10. The foamer 10 comprises a manual air supply pump, generally designated 12, wall mount structure, generally designated 14, a dual reservoir system comprising an elevated pump station, generally designated 16, for storage and successive displacement of predetermined quantities of foamable liquid through the foamer 10 from time-to-time, a dispensing head, generally designated 18, mounted at the top of a relatively large container 20 [forming part of the dual-reservoir system 16] and a foam output spout, generally designated 22, where predetermined quantities of foam are successively discharged from the dispensing head 18, in a manner hereinafter more fully described.

While the manual pump 12 is illustrated as being a piston/cylinder pump, by which air is placed under pressure, first positively, and, thereafter, negatively, it is to be appreciated that other types of pumps could be used in lieu of piston pump 12. For example, it is well known in the non-aerosol foamer art that a bulbous foot pump may be used, thereby providing the advantage to the user of freeing both hands in which to catch the foam discharge from the spout 22.

Piston pump 12 (FIG. 3) comprises a hollow cylindrical casing 24 shown as having an exterior cylindrical exposed surface 26, an interior smooth cylindrical surface 28 and a uniform wall thickness. The cylindrical casing 24 comprises a blunt trailing edge 30 and its leading edge terminates in an inwardly directed radial flange 32 which integrally merges with a reduced diameter annulus 34. Annulus 34 terminates in an exposed annular blunt edge 36. The diameter formed by the annulus 34 is sized so as to snugly, sealingly and reciprocally receive a hollow cylindrical plunger 38. The end of the plunger 38 terminates in an integral actuator cap 40, which extends radially and is anchored by a suitable adhesive or the like to the leading end 42 of the plunger 38.

Unless otherwise stated herein, it is presently preferred that the components of the foamer 10 be fabricated of suitable inert synthetic resinous materials. The manual plunger 38, as stated, has a hollow interior 44. The hollow interior assists, as hereinafter explained in greater detail, in regulating the rate at which the plunger 38 is restored to its fully extended position, which in turn regulates the length of time during which the pump 12 creates a negative pressure to displace foamable liquid from the relatively large reservoir 20 to an elevated pump station. The rate at which the plunger 38 is permitted to be restored to its fully extended position is controlled by the size of a relatively small aperture 46, which laterally traverses between the exterior and interior surfaces of the plunger 38 adjacent the cap 40. By varying the size of the aperture 46, one is able to vary correspondingly the rate of recovery of the plunger 38 to its fully extended position. Thus, the extent to which foamable liquid is displaced by negative pressure is thereby controllable.

The concealed trailing end of the plunger 38 comprises a piston 48. Piston 48 comprises a relatively large axial bore 50 through which air may selectively pass. The piston 48 also comprises an annular radially directed ring 52, which contiguously, sealingly and slidably engages the interior surface 28 of the hollow cylinder 24. The piston 48 also comprises a rearwardly extending, longitudinally or axially directed annulus 52, the outside diameter of which is substantially smaller than the inside diameter of the hollow cylinder 24.

Mounted within the annulus 52 is a cup-shaped valve 54. Valve 54 comprises a relatively short annular flange 56, which is contiguous with the inside surface of the annulus 52 and is there secured, at site 58, by a suitable adhesive. The valve 54 is slit or otherwise cut at site 60, so that the central portion of the valve 54 can be displaced away from the piston 48 toward the rear of the device (toward the left as viewed in FIG. 3) when the air pressure within the interior of the plunger 38 is greater than the air pressure within the hollow cylinder 24. However, when the air pressure within the hollow cylinder 24 is greater than the air pressure within the hollow plunger 38 (i.e. when the plunger is being displaced from right to left as viewed in FIG. 3), the central flap of the valve 54 will close against the piston 48 thereby preventing any air flow from within the cylinder 24 through the bore 50 to the hollow of the plunger 38.

The plunger 38 is caused to return to its fully extended position following each delivery stroke, by a plastic bellows spring 62, the maximum diameter of which is illustrated as being essentially the same as the inside diameter of the hollow cylinder 24. The plastic spring 62 is in a bellow, pleated or an accordion configuration and is preferably cut from a length of stock accordion plastic tubing, readily available from a number of commercial sources. The plastic spring 62 has a hollow interior along its entire length and the leading end thereof is configurated into an annulus 64, which is fastened to the exterior surface of the annulus 52, at site 66, by a suitable adhesive or the like. The trailing end of the plastic spring 62 is also fashioned into an annular configuration, at site 68, and is there secured to the wall mount 14, in a manner hereinafter and more fully explained.

While it should readily be appreciated that the wall mount 14 is only one of many ways in which the foamer 10 can be secured in position for use, either permanently or releasably, the wall mount 14 per se is intended to be a permanent anchor. The wall mount 14 comprises an anchor plate 70 having a front exposed flat surface 72 and a rear flat surface 74, which is preferably secured to a wall, at a suitable elevated position, using an appropriate adhesive.

The back side of the wall mount 14 also comprises a plate 76, the back surface of which is flush with surface 74 and which is recessed in to the plate 70. The cover plate 76 is of uniform thickness and is secured in the illustrated position by adhesive or other suitable bonding agent interposed between the contiguous areas of the plate 76 and the flange 70. The plate 76, in part, defines a generally U-shape passageway 78. The passageway 78 opens at a port 80, where a boss 82 of the flange 70 internally projects into the hollow of the plastic spring 62. The opening 80 of the U-shaped passageway 78 provides air communication between the sealed interior of the plastic spring 62 and the U-shaped passageway 78.

Internal of the hollow interior of the cylinder 24 and the spring 62 is an annular flange 84 projecting forwardly from the front face of the wall mount 14. The annular flange 84, at its exterior surface or outside diameter, is contiguous with the inside diameter of the annular portion 68 of the bellows or accordion plastic spring 62. Adhesive is placed between the annular portions 68 and 84 to secure these parts, one to the other at site 86 in inseparable relation.

The wall mount flange 70 also comprises a boss or annular flange 88. This boss or flange is exposed to view just below the hollow cylinder 24. A hollow plastic tube 90, having an outside diameter equal to the inside diameter of the boss 88 is snugly fitted into the boss 88 and secured at a site 92 by a suitable bonding agent or adhesive. Thus, air may be communicated, in either direction, between the hollow interior 94 of the tube 90 and the U-shaped passageway 78. The flange 70 further comprises another integral annular ring 31 which projects outward from the face 70. The ring 31 has an inside diameter which is essentially the same as the outside diameter of the cylinder 24. The mentioned flange 31 and one end of the cylinder are contiguous and adhesively secured together at site 33.

Figure 3:
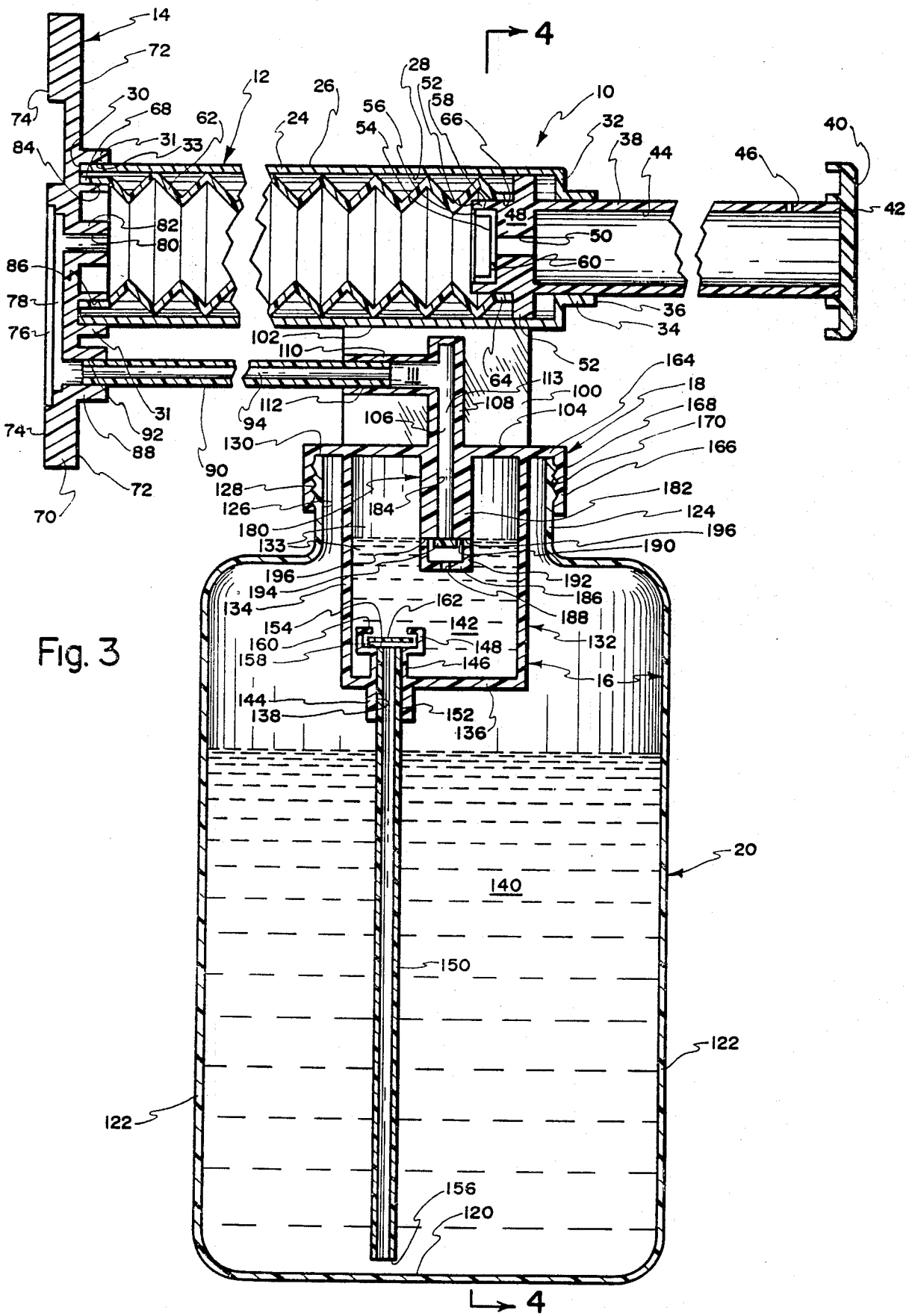
FIG. 3 is a vertical cross section of the foamer of FIG. 1 taken along lines 3—3 of FIGS. 1 and 2.

With continued reference to FIG. 3, there exists a flat columnar flange or support 100 integrally uniting the bottom exterior of the hollow cylinder 24 with the dispensing head 18, the columnar flange 100 connecting along site 102 to the hollow cylinder 24 and to the dispensing head 18 at site 104. There exists an L-shaped passageway 106, comprising walls 108 and 110 contained essentially within the columnar flange 100 in which horizontal and vertical passages 111 and 113 are located. The internal diameter of the horizontal leg 111 is substantially the same as the external diameter of the tube 90, the tube 90 being snugly fitted into and adhesively secured at site 112 to the tube leg 110. Thus, air may be communicated between the hollow 94 of the tube 90 and the L-shaped passageway 106 in the columnar flange 100, for purposes and in a manner hereinafter more fully described.

It should, however, be readily apparent that the positive air pressure created by displacement of the plunger 38 from right to left, to compress the plastic return spring 62, will cause the positive air pressure to be communicated from the interior of the return spring 62 through U-shaped passageway 78, along the hollow interior 94 of the tube 90 and the L-shaped passageway 106.

Likewise when the plunger 38 begins to displace from its maximum depressed position to the left (as viewed in FIG. 3) toward the right at a controlled rate regulated by the size of the aperture 46, a negative pressure will exist within the interior of the plunger 38, the interior of the plastic spring 62, the U-shaped passageway 78, the hollow interior 94 of the tube 90 and the L-shaped passageway 106.

Of particular significance in respect to the present invention, is the reservoir and pump system 16. This particular feature allows the utilization of relatively large containers 20.

The large container or reservoir 20 comprises, in the illustrated embodiment, an exposed, preferably transparent, plastic bottle having a generally flat bottom 120, side walls 122 and a centrally exposed elevated neck 124 equipped with a single elevated relatively large opening 126, the neck being equipped with conventional external threads 128. The neck 124 terminates in an elevated horizontal edge 130.

The elevated reservoir and pump system 16 in the illustrated embodiment comprises an elevated secondary or auxiliary reservoir 132 which comprises a pump station or pump chamber 133. The pump chamber 133 of the reservoir 132 comprises a vertically directed cylindrical side wall 134 and a closed bottom wall 136, which lies in a horizontal plane and is integrally joined to the lower annular edge of the vertical side wall 134. The bottom wall 136 of the auxiliary reservoir or container 132 defines a passageway 138 adapted to provide selective communication of a predetermined quantity of foamable liquid 140, contained within the main reservoir 20 to pass into the pump chamber 133, at location 142, as more fully explained hereinafter. The passageway 138 through the bottom wall 136 comprises a lower annulus or boss 144, integral within and extending downwardly from the wall 136 into the air space hollow interior of the primary reservoir 20. As explained in greater detail herein, the air space in the reservoir 20 above the liquid therein is maintained at all times at atmospheric pressure.

The passageway 138 is further defined by an upwardly directed annular wall 146, which projects into the interior of the secondary or auxiliary pump chamber 133. The annular projection 146 merges upwardly into an annular valve seat body 148.

A linear, vertically depending dip tube or stand pipe 150 is snugly fitted into the aligned bores [of uniform diameter] created by the annulus 144 and the upwardly directed annular projection 146 and is secured in that position at site 152 by a suitable bonding agent or adhesive. The upper edge 154 of the tube 150 is illustrated as being flush with valve seat surface 158 of the valve seat structure 148. The lower edge 156 of the dip tube 150 is located directly adjacent to the bottom wall 120 of the main container or reservoir 20 so that substantially all of the foamable liquid 140 in the main container 20 may be successively displaced, in successive predetermined limited amounts, into the pump chamber 133, as explained herein in greater detail later. The valve seat structure 148 comprises, in addition to the lower valve seat surface 158, elevated, valve-retaining spaced fingers 160.

During those periods of time when the pump chamber 133 is subjected to either atmospheric pressure or pressure greater than atmospheric, a disc shape plastic valve 162 will rest upon the seat surface 158. This will close the dip tube 150 against communication of foamable liquid 142 from the pump chamber 133 to the reservoir 20.

During those intervals of time when the pump chamber 133 is subjected to a negative pressure (less than atmospheric) [as the plunger 38 moves from left to right, as viewed in FIG. 3], the atmospheric pressure within air space at the top of the interior of the main reservoir 20 will cause the disc valve 162 to lift off from its valve seat 158, accommodating flow of foamable liquid 140 from the bottom of the interior of the container 20 upwardly through the hollow interior of the dip tube 150, through the available space within the valve seat structure 148, between the fingers 160 and into the hollow pump chamber 133.

It should be noted that the dispensing head 18 comprises a generally flat, horizontally directed plate 164, to which the columnar flange 100 is integrally connected, at location 104. The cap plate 164 integrally joins, at its perimeter, a downwardly extending annular lip 166. Lip 166 comprises an outer annular smooth surface 168 and an interior threaded surface 170. The diameter of the annular lip 166 and the sizing of the threads 170 are such that the bottle threads 128 are snugly threadedly received by the threads 170 in sealed relation by manual rotation of the bottle 20. In like fashion, the bottle 20 may be unthreaded from the dispensing head cap. The air space at the top of the interior of the reservoir 20 is maintained at atmospheric pressure by air aperture 165 in the plate 164. See FIG. 4.

The secondary or auxiliary container or reservoir 132 integrally depends from the foam dispensing cap 164, in spaced concentric relation to the neck 124 of the main container 20, as best illustrated in FIG. 3. Thus, except for the introduction of air pressure into the pump chamber 133, the cap 164 closes the top of the pump chamber 133. It is to be appreciated that an elevated reservoir and pump system, other than the illustrated embodiment, for creating and transferring both positive and negative manually-obtained pressures to fill and discharge an intermediate relatively small pump chamber are within the scope of the present invention.

The dispensing head 18 comprises structure 180 by which the positive and negative air pressures, from the manual pump 12, are imposed upon the pump chamber 133. This structure comprises a downwardly depending hollow cylinder generally designated 182, which is disposed primarily within the pump chamber 133. Cylinder 180 comprises a cylindrical wall having a hollow cylindrical interior 184. The hollow cylindrical interior or passageway 184 has a diameter substantially the same as and is disposed in alignment with the vertical conduit 113 in which L-shaped passageway 106 is disposed.

Thus, the positive and negative pressures brought into existence in L-shaped passageway 106, in the manner heretofore explained, will be communicated into the hollow interior 184 of the cylindrical housing 182. The lower end of the cylindrical housing 182 is closed by horizontal wall 186, which is integrally joined to the lower end of the cylindrical wall 182 and which has a central aperture 188 disposed therein. The internal diameter of the housing 182 is enlarged at shoulder 190 near the end wall 186 at housing segment 192. This correspondingly reduces the wall thickness of the wall 182 at the lower end 192 thereof. A disc shaped, relatively light valve 194 is disposed between the annular interior surface of the end wall 186 and the annular shoulder 190. The diameter of the disc 194 is less than the interior diameter of the wall segment 192 and greater than the interior diameter of the remainder of the bore 184 of cylindrical housing 182. Thus, disc 194 can move up and down, based upon fluid conditions in the pump chamber 133 between the shoulder 190 and the internal surface of the end plate 186 but is otherwise trapped between those two locations.

When pressure conditions within the interior of the pump chamber 133 are atmospheric or higher and the pump chamber 133 is filled with foamable liquid as illustrated in FIG. 3, the disc valve 194 will come to rest contiguously upon the top surface of the end wall 186. Thus, the mentioned atmospheric or above atmospheric pressure is communicated through the hollow interior 184 of the cylindrical housing 182, through two or more side ports 196 adjacent the shoulder 190, into the elevated air space within the pump chamber 133.

When the pressure delivered from the manual pump 12 in the manner heretofore described, to the air space interior of the pump chamber 133 is greater than atmospheric pressure, the quantity of foamable liquid 142 previously caused to accumulate within the interior of the pump chamber 133 will be discharged therefrom through a foaming device, generally designated 200 (FIG. 4) and out the spout 22 into the free hand of the user, all in a manner hereinafter more fully explained, the above atmospheric pressure, at the same time, causing the disc valve 162 to seal against seat 158 preventing escape of foamable liquid from the pump chamber down the dip tube 150.

Once a predetermined quantity of foam has been so discharged from the output 244 of the spout 22, the plunger 38 of the manual pump 12 will normally be fully depressed into the cylinder 24. When the user releases hand pressure from the face plate 40 of the plunger 38, the plunger 38 will begin its retraction stroke [from left to right as viewed in FIG. 3], with a very small metered amount of air flow being allowed to enter the interior of the plunger 38 through the very small aperture 46. Thus, a negative pressure is retained for a protracted period of time within the pump 12, which negative pressure is imposed, along the route heretofore mentioned, upon the pump chamber 133. At the time when plunger retraction begins, the pump chamber 133 is substantially empty of foamable liquid.

The mentioned negative pressure within the pump chamber 133 will lift the disc valve 162, permitting the pressure differential between the air space interior of the main reservoir 20, which is at atmosphere, and the negative pressure within the air space interior of the secondary reservoir 132 to cause a predetermined quantity of foamable liquid 140 to move up the dip tube 150 around the valve 162 and into the pump chamber 133. This liquid loading cycle continues until the upper surface of the foamable liquid 142 contained within the secondary reservoir 132 reaches the plate 186. The rising foamable liquid then flows through the aperture 188 and lifts the relatively light disc valve 194 from the interior surface of the end plate 186 at the surface of the foamable liquid as its level rises in the pump chamber 133. When the floating valve disc 194 becomes contiguous with the shoulder 190, the vacuum pressure being imposed by the manual pump 12 upon the air space in the pump chamber 133 is negated, and, consequently, further flow of foamable liquid from the large container 20 to the small container 132 terminates.

At this point in time, the level of the liquid in container 132 will be essentially adjacent the two apertures 196, shown in FIG. 3. This is the level reached by the foamable liquid in the pump chamber 133. Thus, the pump chamber 133 above the location of shoulder 190 will at all times contain air at atmospheric pressure, above atmospheric pressure or below atmospheric pressure, depending upon the state of the manual pump 12.

As mentioned, the foam dispensing head 18 comprises a foam producing mechanism 200. See FIGS. 4 and 5, particularly. Foamable liquid is communicated under positive pressure generated by manual pump 12, as heretofore explained, upward from the pump chamber 133 through a delivery pipe 202. Delivery pipe 202 has a hollow cylindrical interior 204, a lower edge 206, disposed adjacent the bottom wall 136 of the secondary reservoir 132 and a top edge 208.

The lid 164 of the foam dispensing head 18 comprises a downwardly projecting annular ring 210. Ring 210 is integral with the lid 164 and comprises a uniform wall thickness defining a smooth exterior surface 212 and a hollow smooth interior cylindrical surface 214. The annular ring 210 terminates in a blunt lower edge 216, which is located at an elevation above the elevation at which shoulder 190 is located. Thus, exclusive of the delivery tube 202, the foam producing device 200 is disposed in the air space above the foamable liquid 142 in the pump chamber 133 at all times and is subjected to the various pressures which are caused to exist in the air chamber located at the top of the pump chamber 133.

A generally cylindrical insert 220 is force fitted into the hollow interior 214 so as to be retained by interference. The cylindrical insert 220 has an outside cylindrical smooth surface, the diameter of which is substantially the same as the inside diameter of the interior surface 214 of the annular ring 210.

Figure 5:
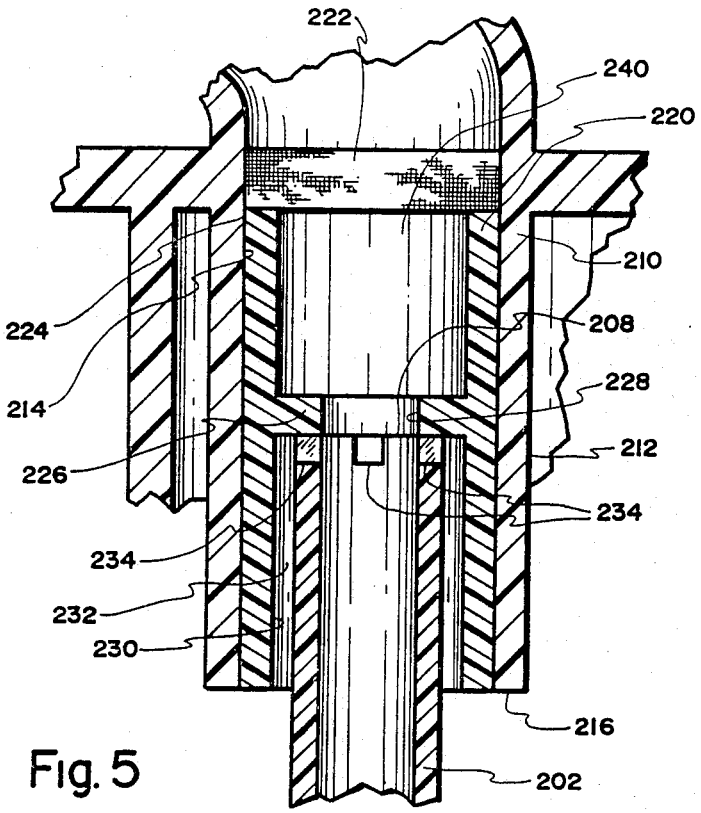
FIG. 5 is an enlarged fragmentary cross section of the foam producing mechanism shown in FIG. 4.
Figure 2:
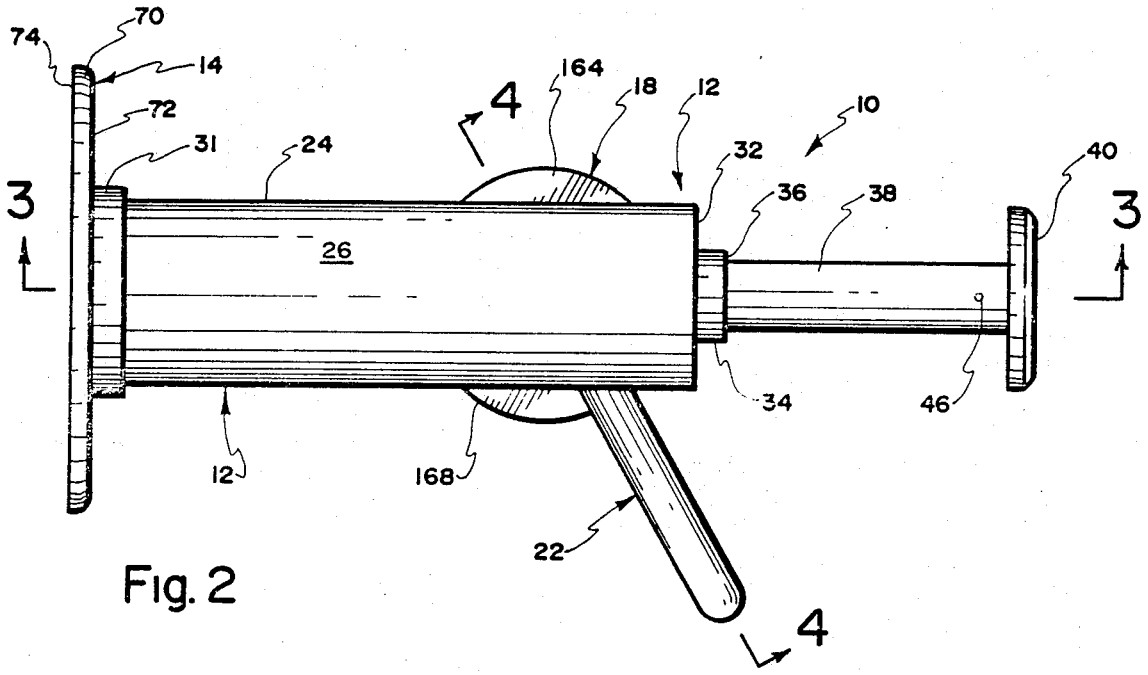
FIG. 2 is a plan view of the foamer of FIG. 1 with the large bottle, reservoir or container removed.
Figure 4:
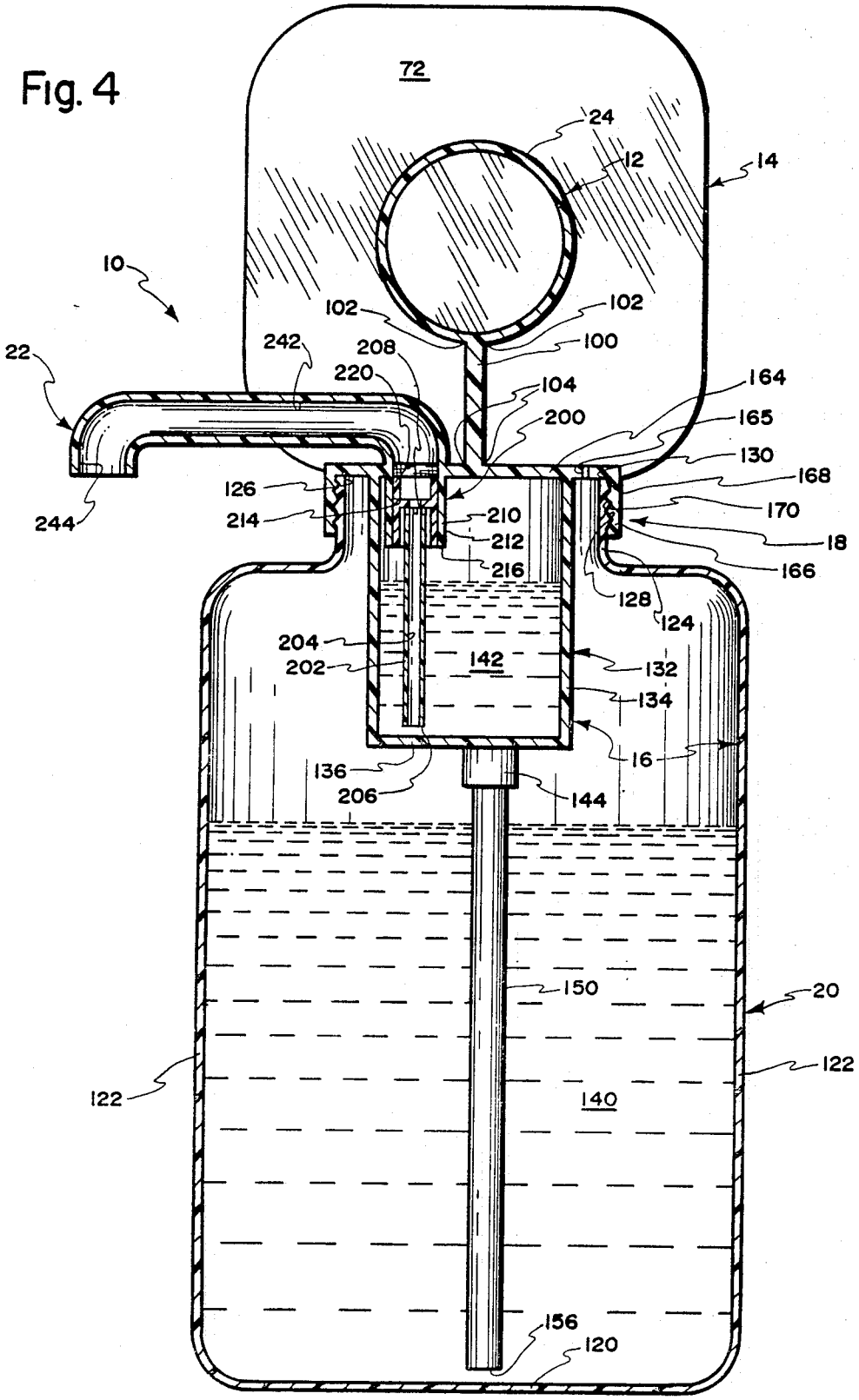
FIG. 4 is a vertical cross sectional view taken along lines 4—4 of FIGS. 2 and 3.

A diffusion filter 222 is placed across and folded over the top annular edge of the cylindrical member 220 before it is force fitted into the position illustrated in FIGS. 4 and 5 so that the filter 222 stretches entirely across the upper end of the cylindrical member 220 along a horizontal plane and annularly down in a vertical direction for a short distance contiguous within the outside cylindrical surface 224 of the housing 220.

At a central location within the otherwise hollow interior of the cylindrical member 220 exists a central horizontal orifice plate 226, which has an axial aperture 228 located therein. See FIG. 5. The illustrated diameter of the orifice or aperture 228 is shown to be the same as the interior diameter of the delivery tube 202. The delivery tube 202 is concentric with the cylindrical housing 220 and aligned with the aperture 228. The outside diameter of the tube 202, however, is less than the inside diameter of the lower end of the housing 220 at interior surface 230. Thus, an annular passage 232 exists between the housing 222 and the delivery tube 202.

The upper end 208 of the tube 202 provides, in the illustrated embodiment, very narrow slots 234 through which a restricted quantity of air is metered when air under positive pressure is caused to exist within the air space of the pump chamber 133. This air, under the indicated positive pressure, will flow along the annular passage 232 and through the very small slots [preferably 20/1000" by 21/1000" each] into the hollow interior of the upper end 208 of the tube 202 into the stream of foamable liquid being simultaneously displaced along tube 202 and thence with the foamable liquid into an enlarged mixing chamber 240 where cavitation and turbulence mixes or interacts the air and the foamable liquid vigorously to produce a foam. This foam, responsive to the force of additional foamable liquid moving up the delivery tube 202, is extruded through the diffusion filter 222, which may be a conventional milk filter to remove large bubbles and homogenize the foam. The resulting foam then flows through the hollow interior 242 of the spout 22 and out the output port 244 of the spout 220 where the foam is delivered to the user. Note that the proximal end of the spout 220 is integral with the lid 164 of the foam dispensing head 18 and that the diameter of the hollow passageway 242 of the output spout 22 is the same as the diameter of the annular ring 210 and is aligned therewith. See FIG. 4.

Before describing the operation of the foamer, it should be restated that a collective foamable liquid passage from reservoir 20 to the mixing chamber 240 is defined by tube 150, the interior of valve seat structure 148, the pump chamber 133, the tube 202 and the orifice 228. A collective passage for air also exists between the air supply pump 12 and the mixing chamber 240 along plunger interior 44, the interior of the bellows 62, U-shaped passageway 78, the hollow 94 of the tube 90, L-shaped passageway 106, the hollow 184 of housing 182, ports 196, the air space in pump chamber 133, annular passageway 232, slots 234 and orifice 228.

Summarizing the operation, the typical beginning point when foam is desired by the user will be when the device 10 is positioned as illustrated in FIG. 3 with a large quantity of foamable liquid 140 located in the large reservoir 20 and a much smaller quantity of foamable liquid 142 located in the pump chamber 133, the top surface of the foamable liquid 142 being located adjacent to the apertures 196. The user advances the plunger 38 of the air supply pump 12 into the cylinder 24 compressing the air therein as contained within the plastic spring 62 and causing said air under pressure to flow through the U-shaped passageway 78, along the hollow 94 of the tube 90, along the L-shaped passageway 106, through the hollow interior 184 of the cylindrical housing 182 and out the ports 196 into the air space at the top of the pump chamber 133. At this point in time, the disc valve 194 is located in contiguous relation with the end plate 186 and the above atmospheric pressure within the air space of the pump chamber 133 forces the disc valve 162 downward to seal against fluid flow along the dip tube 150. The positive pressure so delivered to the air space of the pump chamber 133 drives the foamable liquid 142 downward within the container 132 and upward along the tube 202, and thence into the foam producing mechanism or device 200, where foaming occurs as explained, with the foam being displaced along the hollow interior 242 of the spout 22 and out the port thereof at 244.

At this point in time, the foamable liquid contained within the pump chamber 133 has been substantially evacuated. Also, the plunger 38 is fully extended into the cylinder 24. Release of the plunger 38 by the user, will cause the memory of the plastic spring 62 to begin to slowly displace the plunger 38 from left to right, as viewed in FIG. 3. This displacement is relatively slow, controlled by the rate at which air passes through the plunger aperture 46 accommodating a very limited rate of recovery from negative to atmospheric pressure within the air passage of the foamer 10.

Thus, until the atmospheric pressure is fully restored, over a protracted period of time, the air within the pump 12 and the pump chamber 133 will remain negative. This negative pressure is less than the atmospheric pressure contained within the air space above the liquid 140 in the large container 20, which is isolated from the air passage, and will cause foamable liquid to be displaced up the dip tube 150, around the disc valve 162 and into the lower part of the pump chamber 133 by force of the negative pressure. This loading of a predetermined, although relatively small amount of foamable liquid into the pump chamber 133 continues until such time as the level of the liquid in the pump chamber 133 passes through the aperture 188, lifting the disc valve 194 a sufficient distance to cause the disc valve 194 to seal against the shoulder 190. This eliminates the imposition of the vacuum or negative pressure from the pump 12 upon the air space in the pump chamber 133.

When the plunger 38 has been restored to its fully extended position by action of the plastic spring 62 and the replenishment of air within the hollow interior of the pump 12 through the port 46 has occurred, the pressure within the pump 12 will be at atmospheric pressure. This pressure will be communicated to the disc valve 194 and it will settle into the foamable liquid until it reaches engagement with the end wall 186. Thus, all of the described air passage of the foamer 10 is at atmospheric pressure.

As mentioned heretofore, the present invention provides a unique apparatus and method by which an initially large quantity of foamable liquid can be sequentially displaced in predetermined amounts through a foaming station thereby avoiding the need to frequently reload the reservoir of the foamer with foamable liquid. Furthermore, the amount of foam delivered at any point in time is predetermined and of sufficient amount to accommodate the needs of the user, particularly medical users in hospital and like environments. The present invention prevents overloading of the secondary reservoir and thereby controls to a precisely predetermined amount the quantity of foamable liquid available to be discharged from the foamer during each manual actuation. Likewise, backflow of foamable liquid from the pump chamber 133 along the dip tube 150 to the reservoir 20 is prevented during the delivery stroke of the foamer 10.

The invention may be embodied in other specific forms without departing from the spirit or essential characteristics thereof. The present embodiment is, therefore, to be considered in all respects as illustrative and not restrictive, the scope of the invention being indicated by the appended claims rather than by the foregoing description, and all changes which come within the meaning and range of equivalency of the claims are therefore to be embraced therein.

What is claimed and desired to be secured by United States Letters Patent is:

1. A method for repeatedly forming and dispensing small quantities of foam by entraining air within a foamable liquid in a foaming device successively over an extended period of time without need to replenish the supply of foamable liquid in the device, comprising the steps of:

storing a large quantity of foamable liquid in a large container;

transferring a small predetermined quantity of foamable liquid from the large container along a one-way fluid flow passage to an elevated small pump chamber under force of negative pressure at successive points in time;

terminating the transferring step by flow control action after each said small predetermined quantity of foamable liquid has been accumulated within the elevated small pump chamber;

displacing at least a substantial portion of a known amount of the foamable liquid contained within the small pump chamber from the small pump chamber to a foam-producing site as a liquid stream under force of manually-derived positive pressure;

delivering a regulated flow of air under said force of manually-derived positive pressure to the foam-producing site;

causing a confluence at the foam-producing site by continuously merging the stream of foamable liquid and the flow of air under force of said manually-derived positive pressure to produce foam at the foam-producing site;

displacing the foam along an effluent foam flow path from the foam-producing site to a foam output site;

terminating the delivering step and the causing step, and the two displacing steps by flow control action when the known substantial portion of the small quantity of foamable liquid initially contained within the small pump chamber has been discharged from the small pump chamber to the foam-producing site.

2. A foam-dispensing device comprising:

a relatively large container for holding a supply of foamable liquid;

a relatively small elevated pump chamber for selectively receiving at successive points in time a relatively small definitive amount of said foamable liquid from the large container under force of negative pressure along first flow path means comprising suction tube means and one-way flow control means;

foam-producing means juxtaposed the large container and the pump chamber, the foam-producing means defining a juncture between (a) foam effluent means, (b) foamable liquid influent means and (c) air influent means;

source means by which pressure is obtained;

liquid passageway means by which a predetermined quantity of foamable liquid from the small pump chamber is selectively delivered to the foam-producing means at the liquid influent means;

air passageway means by which the force of positive pressure from the source means is imposed upon the foamable liquid contained within the pump chamber thereby forcing flow of said predetermined quantity of foamable liquid from the pump chamber along the liquid passageway means with a controlled amount of air under said positive pressure being displaced along the air passageway means through the air influent means into the foam-producing means to foam the flowing foamable liquid as it passes through the foam-producing means;

second flow control means accommodating imposition of the force of negative pressure through the interior of the pump chamber, through the one-way flow control means and through the interior of the suction tube means to draw another definitive amount of foamable liquid from the large container up the suction tube means, across the one-way flow control means and into the pump chamber to recharge the pump chamber with foamable liquid;

the second flow control means terminating each said displacement of foamable liquid into the elevated pump chamber when the definitive amount of foamable liquid has been so displaced to the pump chamber.

3. A method by which foam is formed from a liquid within and dispensed from a foamer under manually-derived pressure, comprising the steps of:

placing a supply of foamable liquid in a large container of the foamer;

causing a relatively small predetermined amount of said foamable liquid to be selectively displaced along a one-way flow path at least somewhat counter to gravity under force of negative pressure at successive desired points in time from the large container to a relatively small elevated chamber of the foamer, following but not during selective discharge of foamable liquid from the small chamber; terminating displacement of said foamable liquid in response to the accumulation of said relatively small predetermined amount of foamable liquid selectively imposing the force of manually-derived positive pressure upon the foamable liquid in the small chamber while preventing both the positive pressure from being imposed upon the foamable liquid in the large container and flow of foamable liquid from the small chamber to the large container, thereby forcing flow of a predetermined quantity of foamable liquid from the small chamber only to a foam-producing site where a controlled amount of air under said positive pressure is entrained within the flowing foamable liquid to foam said flowing foamable liquid at the foam-producing site, the foam being extruded at a slow rate from the foam-producing site to a foam discharge site.

4. A foamer operable under manual pressure actuation comprising:

a supply of foamable liquid disposed in a large container;

a small pump chamber disposed at an elevated location in the foamer;

one-way flow control means by which a relatively small predetermined amount of foamable liquid is displaced from the large container to the small chamber on successive occasions counter to gravity under force of negative pressure when foam is not being produced;

flow terminating means by which said flow of foamable liquid to the small chamber is stopped when the small chamber has received said small predetermined amount of foamable liquid;

source means by which pressures are selectively derived and selectively imposed upon foamable liquid in the foamer;

said one-way flow control means preventing counterflow of foamable liquid from the small chamber to the large container;

foam-producing means juxtaposed the larger container and the small pump chamber;

foamable liquid flow path means interposed between the small chamber and the foam-producing means;

means causing the interior of the large container above the foamable to remain at atmospheric pressure;

means imposing the positive pressure force upon the small amount of foamable liquid in the small chamber thereby displacing the same as a stream from the small chamber along the foamable liquid flow path means to the foam-producing means;

means accommodating delivery of air under positive pressure to the foam-producing means where the air is continuously entrained within the foamable liquid as it flows into the foam-producing means;

foam effluent means along which the foam is discharged from the foam-producing means.

* * * * *